United States Patent [19]

Brady et al.

[11] Patent Number: 4,505,203

[45] Date of Patent: Mar. 19, 1985

[54] FRANGIBLE BALLAST

[75] Inventors: D. Ward Brady, New Brighton; James F. Chapman, Waverly, both of Minn.

[73] Assignee: Honeywell Inc., Minneapolis, Minn.

[21] Appl. No.: 463,693

[22] Filed: Feb. 4, 1983

[51] Int. Cl.[3] ..... F42B 25/20

[52] U.S. Cl. ..... 102/382; 102/293; 102/393

[58] Field of Search ..... 102/393, 395, 382, 389, 102/491, 496, 498, 529, 455, 522, 506, 293

[56] References Cited

U.S. PATENT DOCUMENTS

| | | | |
|---|---|---|---|
| 2,809,583 | 10/1957 | Ortynsky et al. | 102/393 |
| 3,422,761 | 1/1969 | Whitmore | 102/455 |
| 3,599,568 | 8/1971 | Shellnutt et al. | 102/455 |
| 3,656,433 | 4/1972 | Thrailkill et al. | 102/455 |
| 3,818,833 | 6/1974 | Throner, Jr. | 102/393 |
| 3,980,019 | 9/1976 | Anderson et al. | 102/393 |

*Primary Examiner*—Charles T. Jordan

*Attorney, Agent, or Firm*—George W. Field

[57] ABSTRACT

In combination: an elongated container comprising a plurality of explosively separable parts extending rearwardly from a closed forward end; a load in the rearward end of said container; and a frangible, unitary ballast member in the container between the closed end and the load.

2 Claims, 6 Drawing Figures

FRANGIBLE BALLAST

The Government has right in this invention pursuant to Contract No. F08635-80-C-0140, awarded by the Department of the Air Force.

FIELD OF THE INVENTION

This invention relates to the field of munitions, and particularly to means facilitating the dispensing of multiple munitions from a container to be carried by and launched from an airborne aircraft or missle.

BACKGROUND OF THE INVENTION

One of the available procedures in warfare is aerial bombing, that is, delivery of munitions from an overflying aircraft to impact on targets below. There are circumstances under which the object to be accomplished is best served by the use of a plurality of small submunitions, or bomblets, rather than a single large bomb, and for this purpose the technique of cluster bombing has been developed.

In this technique an elongated dispensing container is carried by the aircraft, being releasably suspended beneath a wing of the craft. The container has a closed front end, which may include a time fuse or proximity sensor, and is provided with a tail assembly having deployable and sometimes cantable rearward fins, so arranged that when the container is released it is initially directed aerodynamically to move along a path generally parallel to that of the launching aircraft itself, and is later caused aerodynamically to spin about its axis.

The container is intended to accommodate various predetermined submunition loads inserted through the open rear end of the container, which is then closed with a bulkhead and which then receives the tail assembly. The location of the center of gravity of the loaded container varies with load and load distribution. The container is launched with its longitudinal axis aligned with the forward movement of the aircraft, and variation in the axial location of the center of gravity influences the direction of movement of the container in a vertical plane after release, and might even cause the container to move upward toward the launching aircraft under some adverse circumstances. Accordingly, it has been the practice to secure within the container, between the closed front end and the load, ballast means weighted in accordance with the known weight distribution of each intended load, for bringing the overall center of gravity of the loaded container to a predetermined desired location along the axis.

Another characteristic of the containers is that each is divisible explosively by linear shaped charges extending outwardly from the center of the closed end and then extending rearwardly along the container and circumferentially at its rear end. After the container has been released from the aircraft, the charges are fired, by a time fuze or other suitable means, and the container is thereupon divided into a predetermined number of individual portions which move away from each other, releasing the enclosed submunitions to fall independently and be aerodynamically scattered, or perhaps to be lowered on individual parachutes.

In order to permit the individual container portions to separate, the ballast means has heretofore been made in the form of separate sector discs of heavy metal individually bolted to the forward end of the container at sites between the shaped charges, so that each sector is free to remain with one of the container portions after their mutual separation It has been found, however, that the presence of these massive ballast sectors adversely influences the mutual movements of the dispenser portions after separation, and tends to impede dispersal of submunition into the airstream.

BRIEF SUMMARY OF THE INVENTION

The present invention contemplates forming the ballast means as a single, unitary member pressed into the dispenser adjacent to the closed end thereof. The member is frangible so that it fractures rather than preventing the explosive separation of the dispenser portions: it also tends to disintegrate further under aerodynamic stresses into a considerable number of smaller fragments, which are individually of insufficient magnitude to interfere with the dispersal of the munitions being dispensed. The member is of foamed plastic containing a sufficient number of heavy particles, such as lead shot, to give the required counter-weight mass: the plastic is of good strength in compression, but only slight strength in tension, to enable the fracture and disintegration described above.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding elements throughout the several views.

DESCRIPTION OF THE PREFERRED EMBODIMENT

Figure 1:
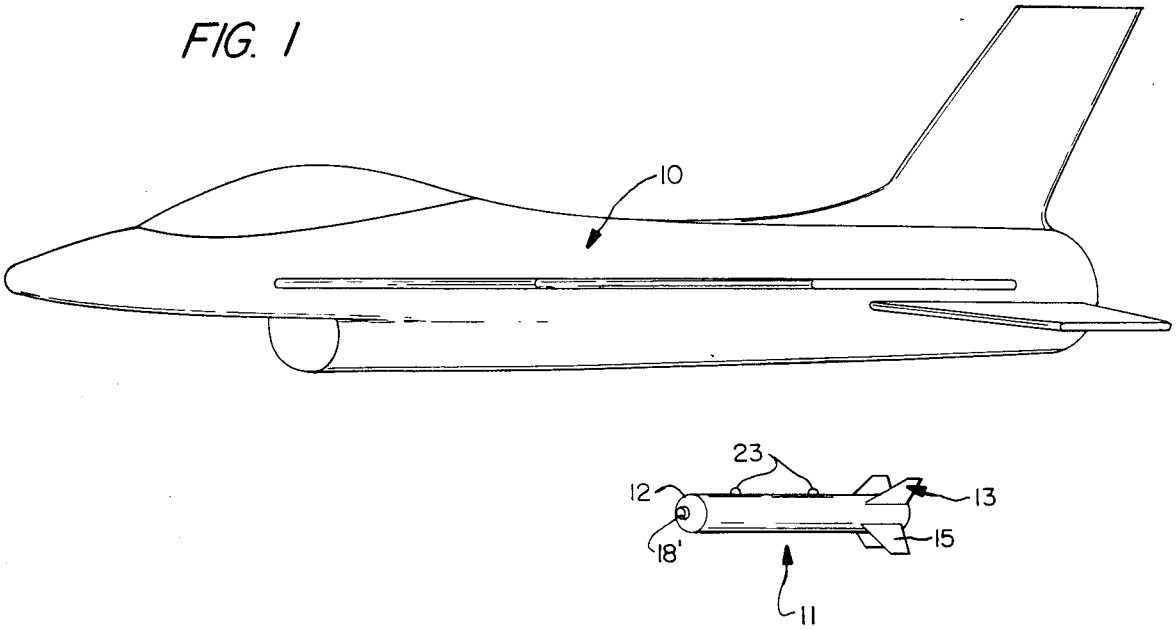
FIG. 1 shows a dispenser being released from an aircraft.
Figure 3:
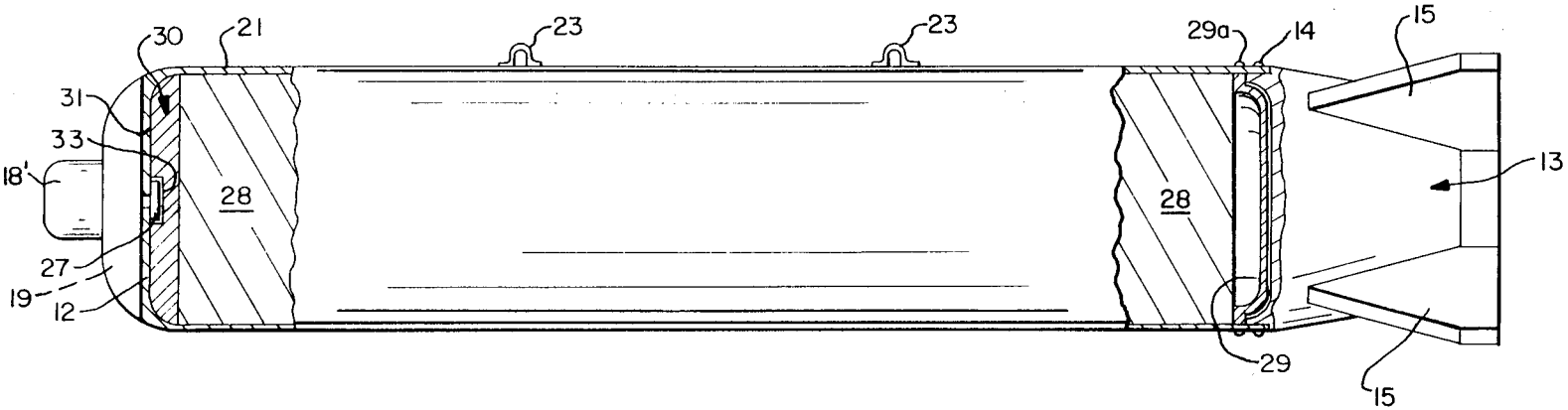
FIG. 3 is a view generally like FIG. 2 but showing a loaded container.

Turning now to FIG. 1, there is shown the launching from an aircraft 10 of a container 11 for dispensing of submunitions enclosed therein. Container 11 has a closed front end 12 and a tail assembly 13 secured by fasteners 14 (FIG. 3). Assembly 13 includes a plurality of retractable and cantable rear fins, shown schematically at 15, which have been deployed to guide the container so that as it descends it initially maintains its longitudinal axis generally parallel to its position at the moment of launch. It will be appreciated that in order for this to happen the center of gravity of the loaded container must be at a particular location along the container axis.

Figure 2:
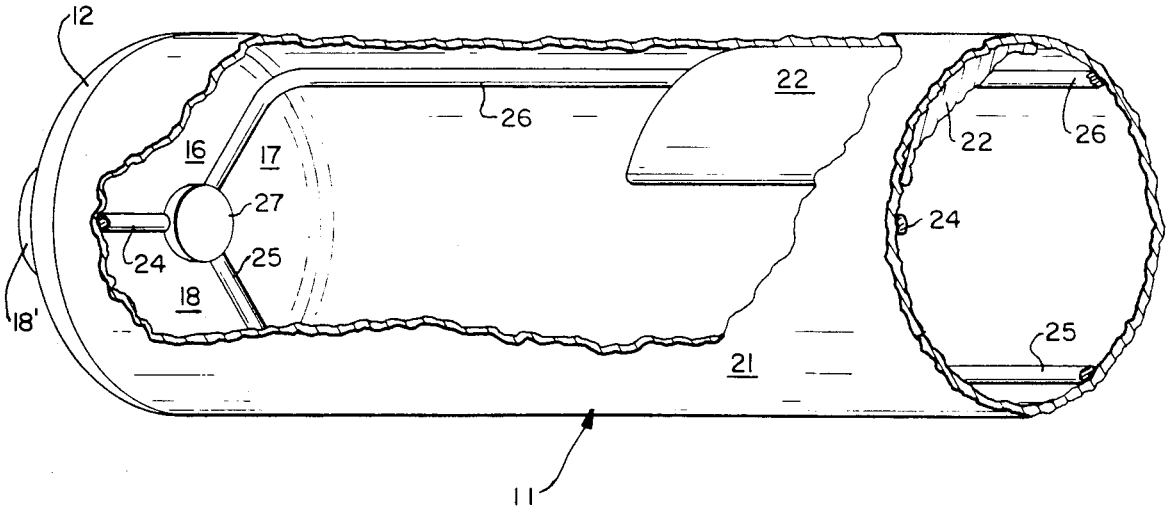
FIG. 2 is a fragmentary view showing the front portion of a container according to the invention before loading, parts being broken away for clarity of illustration.

The forward portion of a container 11 prior to loading is presented in FIG. 2, which shows that the container comprises a sheet metal cylinder 21 extending rearwardly along an axis from a closed forward end 12 carrying a sensor 18' and enclosing a suitable timer or fuze suggested at 19 (FIG. 3). Cylinder 21 is broken away to show that a longitudinal reinforcement or "strongback" 22 extends along a central portion of the cylinder, to receive fasteners 23 (FIG. 3) by which the aircraft may support the container.

FIG. 2 also shows that a plurality of linear shaped charges 24, 25, and 26 extend from a central firing portion 27 along the inner surface of closed end 12 to divide that surface into portions 16, 17, and 18. The charges extend rearwardly along the inner surface of cylinder 21, and then circumferentially at the rear of cylinder 21. Upon firing, these charges act outwardly to divide the container into a plurality of distinct, completely separated portions, one of which includes strongback 22 and another of which includes sensor 18'. They also release the tail assembly and a rear bulkhead 29 showing in FIG. 3.

That figure schematically shows a loaded container. The container is intended to deliver a number of different but predetermined cargos, which may be banded with suitable dunnage, if desired, for insertion into the container from its rear end, the configuration of the cargo being such as to avoid interference with strongback 22. Such cargo is suggested in FIG. 3 by reference numeral 28, and is secured in the container by rear bulkhead 29 and peripheral fasteners 29*a*. The location of the center of gravity of the loaded cylinder along its axis obviously varies with variations in the load makeup.

In order that the center of gravity of the loaded cylinder may be at a predetermined site along its axis, a ballast 30 is provided to be inserted into the cylinder before the load is inserted. The mass of the ballast for each cargo is chosen in accordance with the known weight distribution of the cargo. Ballast 30 is configured to be a press fit into the closed end 12 of the container, and may, if desired, be initially secured by adhesive 31.

Figure 5:
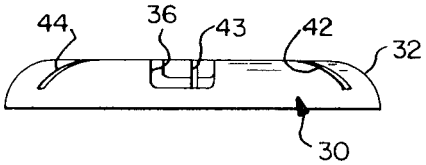
FIGS. 4 and 5 are front and bottom views of a ballast according to the invention.
Figure 4:
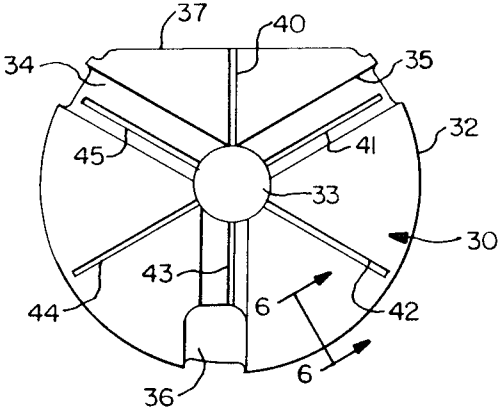

The configuration of ballast 30 is shown in FIGS. 4 and 5. It comprises a generally circular disk having a periphery 32 curved to fit the inside of end 12, with a central depression 33 to receive central firing portion 27, and radial grooves 34, 35, and 36 to accommodate shaped charges 24, 25, and 26. A portion 37 of the periphery of the disk is cut away to avoid interference with strongback 22 during insertion of the disk into the cylinder. In addition, the ballast is deeply scored at 40, 41, 42, 43, 44, and 45 to facilitate fracture.

Figure 6:
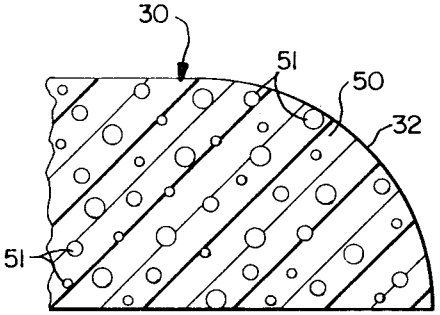
FIG. 6 is an enlarged fragmentary section along the line 6—6 of FIG. 4.

Ballast 30 is shown in FIG. 6 to be made of a plastic foam 50 into which there is admixed a quantity of particles 51 of high density, such as lead shot. The shot makes up a principal portion of the total mass of the ballast, which is determined by the mass ratio of the shot to the plastic, and by the thickness of the disk, the latter also being influenced by the dimensions of the particular cargo. A different ballast is to be provided for each different predetermined cargo.

The plastic foam of which ballast 30 is made has the characteristics of good strength in compression, but slight strength in tension. One such plastic is polyurethane.

The mechanical structure of the container, and the operation of fins 15, sensor 18', and fuze 19 are not parts of the present invention.

OPERATION

In operation, when a cargo is prepared for the container, and a ballast is selected appropriate to the cargo. The ballast is inserted into a container until it seats against the inside of the closed end, an adhesive being used, if desired, to slightly augment the normal press fit of the ballast into the container. The cargo is then slid into the container, rear bulkhead 29 is inserted and fin assembly 13 is attached. The container is now ready to be supported in an aircraft on fasteners 23.

When the aircraft reaches the desired altitude and location, the container is released. It initially falls with its axis in the direction of movement to the aircraft, the use of a proper ballast 30 cooperating with fins 15, now deployed by fuze 19, to ensure this. As air friction reduces the forward speed of the container, and gravity increases its downward speed, the container may gradually nose down during flight. After an appropriate interval the fins are canted in unison by fuze 19 to cause spin of the container about its axis, to facilitate cargo dispersion.

Next, the shaped charges are fired, and separate the container into three distinct longitudinal parts which move away from each other, and from the rear assembly which is also separated explosively, to release the cargo. Member 18' remains with one portion of the container, strongback 22 remains with one portion, and bulkhead 29 and fin assembly 13 form another separated unit. It has been found that ballast 30 readily separates, not only along the scores provided, but also between them, disintegrating into a considerable number of irregular fragments which move generally in the outward direction. These fragments are individually not massive, and if engagement takes place between a cargo element and a ballast fragment no unfortunate result occurs.

The cargo elements are not damaged by the shaped charges, and are dispersed centrifugally and aerodynamically to perform their intended functions, unimpeded and uninfluenced by the container portions and the ballast fragments, which fall separately.

From the above it will be evident that the invention comprises a ballast made up of a selected proportion of particles of high density dispersed in a plastic foam of good strength in compression and low strength in tension, the ballast being unitary but being arranged to separate into a plurality of fragments upon explosive separation of a container in which the ballast is mounted to bring the center of gravity of the loaded cylinder to an initial predetermined axial position.

We claim:

1. In combination:

an elongated container comprising a plurality of explosively separable parts extending rearwardly from a closed forward end;

a load in the rearward end of said container;

and a frangible, unitary ballast member in said container between said closed end and said load, said container being separable by flexible linear shaped charges extending across said closed end, and said ballast member being weakened along lines adjacent to said charges.

2. A ballast member comprising a plate of plastic material containing distributed particles of high density, in which said plate is weakened along predetermined lines to facilitate shattering under applied tensile force along said lines.

* * * * *